US005510881A

United States Patent [19]

Smith et al.

[11] Patent Number: 5,510,881

[45] Date of Patent: Apr. 23, 1996

[54] POSITIVE PUSH DEVELOPMENT AUGER

[75] Inventors: Lewis S. Smith, Fairport; Thomas W. Nash, Ontario; Steven C. Hart, Webster, all of N.Y.

[73] Assignee: Xerox Corporation, Stamford, Conn.

[21] Appl. No.: 341,810

[22] Filed: Nov. 18, 1994

[51] Int. Cl.[6] ..... G03G 15/08

[52] U.S. Cl. ..... 355/245; 355/253; 118/653; 198/550.6; 198/570

[58] Field of Search ..... 355/245, 253, 355/259; 118/656–658, 653; 198/545, 550.6, 550.01, 560, 570, 657, 671

[56] References Cited

U.S. PATENT DOCUMENTS

| | | | |
|---|---|---|---|
| 4,187,030 | 2/1980 | Godley | 366/319 |
| 4,813,531 | 3/1989 | Tannascoli et al. | 198/671 |
| 4,864,349 | 9/1989 | Ito | 355/253 |
| 4,937,625 | 6/1990 | Kato | 355/245 |
| 4,978,997 | 12/1990 | Bell | 355/253 |
| 4,980,724 | 12/1990 | Tanaka | 355/245 |
| 4,996,565 | 2/1991 | Herley | 355/245 |
| 5,151,739 | 9/1992 | Hediger | 355/245 |
| 5,196,890 | 3/1993 | Nakayama et al. | 355/259 |
| 5,220,382 | 6/1993 | Hediger | 355/245 |
| 5,250,749 | 10/1993 | Aimoto | 355/245 X |
| 5,355,199 | 10/1994 | Bray | 355/245 |

*Primary Examiner*—R. L. Moses
*Attorney, Agent, or Firm*—John S. Wagley

[57] ABSTRACT

An apparatus for recirculating developer material in a developer unit. The apparatus includes a first transporter for transporting the developer material in a first direction, a second transporter for transporting the developer material in a second direction opposite to the first direction, and a mover for moving the developer material from the first transporter to the second transporter.

30 Claims, 5 Drawing Sheets

POSITIVE PUSH DEVELOPMENT AUGER

The present invention relates to a method and apparatus for transporting developer material. More specifically, the invention relates to an auger for transporting developer material.

The features of the present invention are useful in the printing arts and more particularly in electrophotographic printing. In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as "toner". Toner is held on the image areas by the electrostatic charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is cleaned from the surface. The process is useful for light lens copying from an original or for printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner to the latent image at a controlled rate so that the toner effectively adheres electrostatically to the charged areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which typically are comprised primarily of ferrous material. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll". The developer roll is typically in the form of a cylindrical sleeve rotating around a fixed assembly of permanent magnets. The carrier beads form chains extending from the surface of the developer roll, and the toner particles are electrostatically attracted to the chains of carrier beads. When the magnetic brush is introduced into a development zone adjacent the electrostatic latent image on a photoreceptor, the electrostatic charge on the photoreceptor will cause the toner particles to be pulled off the carrier beads and onto the photoreceptor.

When utilizing two component development, the toner particles are attracted by the latent image, transferred to the copy paper and thereby consumed. The carrier particles, on the other hand, are not so attracted and return to the developer sump. The consumed toner must thereby be replaced. The electrophotographic printer thus includes a refillable or replaceable toner container from which additional toner particles are regularly added to the developer unit. The replacement toner must be thoroughly mixed with the carrier particles in order that the toner particles triboelectrically adhere to the carrier particles to form a magnetic brush as described above.

A mixing apparatus, usually in the form of an auger or augers, is typically added to the development sump to constantly mix the newly added toner particles into the developer material. The auger also serves to agitate the toner particles and carrier beads to assist the triboelectric charging thereof. The auger also provides for developer material transport in order to maintain a generally uniform toner concentration within the developer housing. Typical augers have a spiral screw type configuration with left hand and right hand spiral portions. An alternative prior art auger is in the form of a pseudo-auger. The pseudo-auger comprises a series of parallel plates skewed to the axis of the auger at varied angles each plate being approximately a one half of an ellipse which when the pseudo auger is rotated, translates the developer material along the axis of the transporter.

Typically the mixing apparatus consists of two spaced apart parallel augers. The augers are preferably located in separate channels with the lower portion of the channels closely conforming to the augers. Developer material is transferred from the first auger to the second auger through a first port and from the second auger to the first auger through a second port. The inability to efficiently move developer material through either port causes many undesirable phenomenon to occur. In particular, dead zones occur in the mixing apparatus adjacent the ports. Only minimal mixing and agitation occurs in the dead zone. Additionally, the flow of developer material through the mixing apparatus is reduced which can lead to a back-up of material prior to the second port which in turn can lead to a non-uniform loading of developer material onto the magnetic roller. The dead zones can also lead to clumping of toner adjacent to the ports.

The following disclosures may be relevant to various aspects of the present invention:

US-A-5,220,382

Patentee: Hediger

Issue Date: Jun. 15, 1993

US-A-5,151,739

Patentee: Hediger

Issue Date: Sep. 29, 1992

US-A-4,996,565

Patentee: Herley

Issue Date: Feb. 26, 1991

US-A-4,980,724

Patentee: Tanaka

Issue Date: Dec. 25, 1990

US-A-4,813,531

Patentee: Tannascoli et al.

Issue Date: Mar. 21, 1989

US-A-4,187,030

Patentee: Godley

Issue Date: Feb. 5, 1980

US-A-5,220,382 discloses a dual auger development apparatus for use in an electrostatographic reproduction machine. The apparatus includes a pair of augers each having a shaft and integral partial blade members. A cross mixing vane is formed circumferentially from the partial blades.

US-A-5,151,739 discloses a dual auger development apparatus for use in an electrostatographic reproduction machine. The apparatus includes a pair of augers each having a shaft and integral partial blade members. A last blade member includes a cross transfer member connected thereto and integrally formed therewith.

US-A-4,996,565 discloses an apparatus which mixes developer material in the chamber of a developer housing a pair of augers transports the developer material in a recirculating path from one region of the chamber to another region. A generally planar member is interposed between the augers to separate the augers from one another. The planar member has an aperture in at least one marginal region configured to allow developer to gently move between the first auger and the second auger and being adapted to reduce back up of the developer material and flow unevenness. Between the augers the developer material is directed laterally into the other auger.

US-A-4,980,724 discloses an apparatus which mixes developer material in the chamber of a developer housing. An auger transports the developer material in an axial direction from one region of chamber to another region thereof. In addition, as the developer material is being advanced in the axial direction, it is being moved in a radial direction substantially perpendicular to the axial direction of movement. In this way, the charge characteristics of the developer material are provided.

US-A-4,813,531 discloses a developer transport apparatus including a developer auger which has an antibridging device at its delivery end which is a flexible paddle wheel mounted through the shaft of the auger and rotatable therewith. The flexible paddle wheel has a length greater than the diameter of the containment tube.

US-A-4,187,030 discloses an interlocking auger-mixer mechanism especially adapted to transport and mix developer compositions containing toner, or similar materials, prior to the feeding of such materials through an output port in the operation of a xerographic copying machine. The mechanism includes a plurality of fins sections having primary and secondary fins wound in reverse helical directions.

SUMMARY OF THE INVENTION

In accordance with one aspect of the present invention, there is provided an apparatus for recirculating developer material in a developer unit. The apparatus includes a first transporter for transporting the developer material in a first direction, a second transporter for transporting the developer material in a second direction opposite to the first direction, and a mover for moving the developer material from the first transporter to the second transporter.

In accordance with another aspect of the present invention, there is provided a particle transport having a spiral auger including a first vane section for moving particles in a first direction, a second vane section for moving particles in a second direction opposite to the first direction, and an urging member connected to either the first vane section or the second vane section, or connected to both sections, to move particles substantially transverse to the first direction.

In accordance with a further aspect of the present invention, there is provided a printing machine of the type having developer material recirculated in a developer unit. The improved printing machine includes a first transporter for transporting the developer material in a first direction, a second transporter for transporting the developer material in a second direction opposite to the first direction, and a mover for moving the developer material from the first transporter to the second transporter.

BRIEF DESCRIPTION OF THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 5:
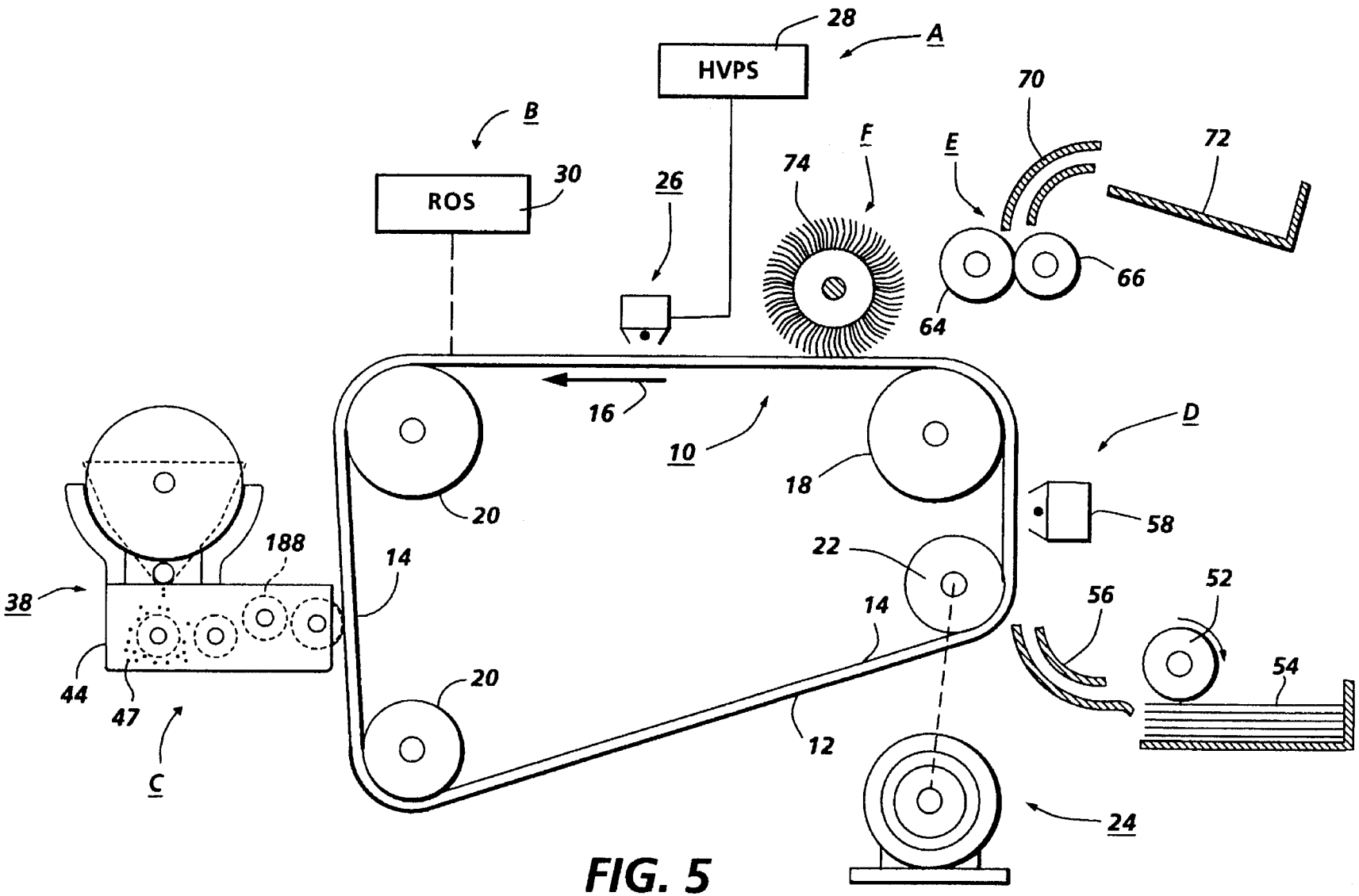
FIG. 5 is a schematic elevational view of an illustrative electrophotographic printing machine incorporating the positive push auger of the present invention therein.

For a general understanding of the illustrative electrophotographic printing machine incorporating the features of the present invention therein, reference is made to the drawings. In the drawings, like reference numerals have been used throughout to designate identical elements. FIG. 5 schematically depicts the various components of an electrophotographic printing machine incorporating the positive push auger of the present invention therein. Although the positive push augers of the present invention are particularly well adapted for use in the illustrative printing machine, it will become evident that these positive push augers are equally well suited for use in a wide variety of printing machines and are not necessarily limited in their application to the particular embodiments shown herein.

Referring initially to FIG. 5, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably, the surface 12 is made from a selenium alloy or a suitable photosensitive organic compound. The substrate 14 is preferably made from a polyester film such as Mylar® (a trademark of Dupont (UK) Ltd.) which has been coated with a thin layer of aluminum alloy which is electrically grounded. The belt is driven by means of motor 24 along a path defined by rollers 18, 20 and 22, the direction of movement being counterclockwise as viewed and as shown by arrow 16. Initially a portion of the belt 10 passes through a charge station A at which a corona generator 26 charges surface 12 to a relatively high, substantially uniform, electrical potential. A high voltage power supply 28 is coupled to device 26.

Next, the charged portion of photoconductive surface 12 is advanced through exposure station B. At exposure station B, ROS 30 lays out the image in a series of horizontal scan lines with each line having a specified number of pixels per inch. The ROS includes a laser having a rotating polygon mirror block associated therewith. The ROS exposes the charged photoconductive surface of the printer.

After the electrostatic latent image has been recorded on photoconductive surface 12, belt 10 advances the latent image to development station C as shown in FIG. 5. At development station C, a development system 38, develops the latent image recorded on the photoconductive surface. The chamber in developer housing 44 stores a supply of developer material 47. The developer material may be a two component developer material of at least magnetic carrier granules having toner particles adhering triboelectrically thereto. It should be appreciated that the developer material may likewise comprise a one component developer material consisting primarily of toner particles.

Again referring to FIG. 5, after the electrostatic latent image has been developed, belt 10 advances the developed image to transfer station D, at which a copy sheet 54 is advanced by roll 52 and guides 56 into contact with the developed image on belt 10. A corona generator 58 is used to spray ions onto the back of the sheet so as to attract the toner image from belt 10 the sheet. As the belt turns around roller 18, the sheet is stripped therefrom with the toner image thereon.

After transfer, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine by the operator.

After the sheet is separated from photoconductive surface 12 of belt 10, the residual toner particles adhering to photoconductive surface 12 are removed therefrom at cleaning station F by a rotatably mounted fibrous brush 74 in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1A:
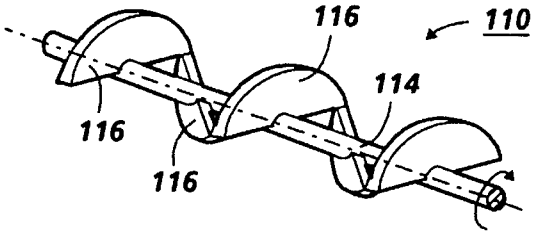
FIG. 1A is a partial perspective view of a pseudo auger for use with the positive push auger of the present invention.
Figure 1:
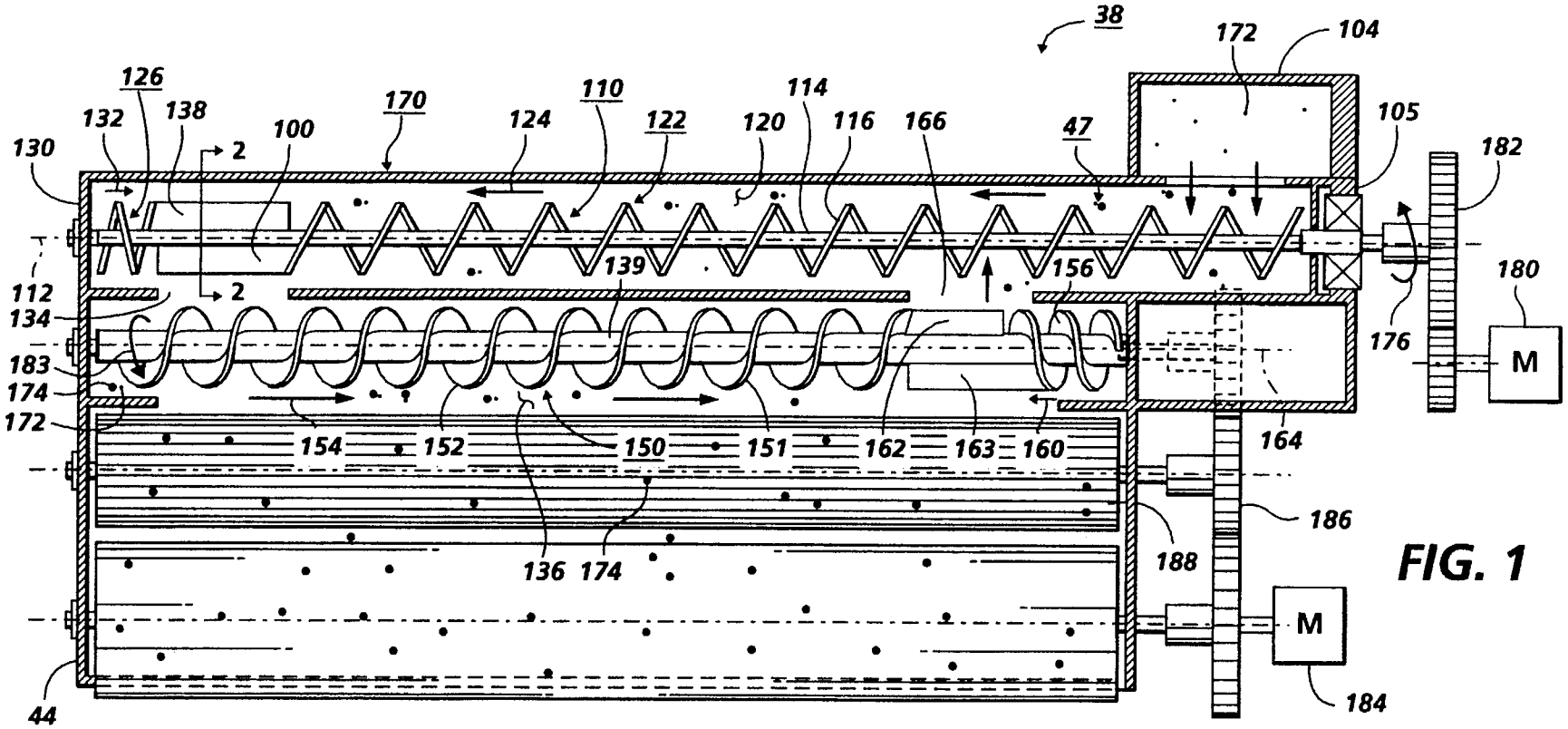
FIG. 1 is a plan view partially in section of a first embodiment of the positive push auger of the present invention.

According to the present invention, and referring to FIG. 1, the development system 38 is shown including a first positive push developer urging member 100. The development system 38 includes the developer housing 44 to which a sump housing 104 is attached at a first end 105 thereof. The sump housing 104 stores a supply of at least toner 172 for developing a latent image upon the photoreceptor belt 10 (see FIG. 5).

The toner 172 is drawn from the sump housing 104 by a first developer transporter 110. The first developer transporter 110 may be in any form that may transfer the toner 172 along first developer material transport axis 112 away from the sump housing 104. For example, the first developer transporter 110 may be in the form of a spiral auger or a pseudo auger. Preferably, however, the first developer transporter 110 is in the form of a pseudo auger.

Referring now to FIG. 1A, the pseudo auger 110 is shown in greater detail. The pseudo auger 110 typically includes a first auger shaft 114 about which pseudo auger vanes 116 extend. The vanes 116 are preferably in the form of flat elliptically shaped plates which are located in a skewed position relative to the shaft 114.

Referring again to FIG. 1, the vanes 116 rotate in a direction to urge the developer material 47 along the shaft 114. The vanes 116 are superior to a spiral auger in mixing the toner 172 with the developer material 47.The pseudo auger 110 is located in a first channel 120 of the developer housing 44 and confines the toner 172 and the developer material 47 to travel along the channel 120.

The first auger vanes 116 may be of a solid type as shown in FIG. 1, or consist of outwardly extending bristles (not shown). The bristles (not shown) may be made of any suitable durable material such as a plastic. The first auger vanes 116 and the first auger shaft 114 may be made of any suitable durable material, such as a plastic or a metal. The vanes 116 and the shaft 114 may be made of dissimilar materials or be made of a similar material. If made of a similar material, the vanes 116 and the shaft 114 may be integrally manufactured. For example, if the vanes 116 and the shaft 114 are made of a plastic material, they may be integrally molded thereof.

The pseudo auger 110 includes a first vane portion 122 for urging the developer material 47 in a first direction 124 away from the sump housing 104 and a second vane portion 126 for transporting the developer material 47 away from a second end 130 of the developer housing 44 in a second direction 132.

The pseudo auger 110 further includes the first developer urging member 100 which is located between the first portion 122 of the auger 110 and the second portion 126 of the pseudo auger 110.

The first developer urging member 100 assists the transfer of the developer material 47 from the first channel 120 through a first port 134 to a second channel 136. The second channel 136 is preferably generally parallel to and spaced from the first channel 120. The first member 100 is located in general alignment with the first port 134 to permit it to be effective in the transfer of material 47 from the first chamber 120 to the second chamber 136. To move from the first channel 120 to the second channel 136, the developer material 47 must therefore move outwardly from the pseudo auger 110 in a radial direction. The developer urging member 100, therefore, needs to be so designed to urge the developer material 47 in a generally radial direction. The first urging member 100 is preferably in the form of a plate which is spaced outwardly from the shaft 114 of the pseudo auger 110. The first plate 100 is preferably connected to either the first portion 122 or the second portion 126 of the pseudo auger 110. As shown in FIG. 1, the first plate 100 is connected to the first portion 122 of the pseudo auger 110. It should be appreciated that the first plate 100 may likewise be connected to the second portion 126 of the pseudo auger 110. The first plate 100, as shown in FIG. 1, is connected to the vane 116 of the pseudo auger 110. The first plate 100 may alternatively be connected to the shaft 114.

Depending on the direction of rotation of the pseudo auger 110, the first portion 122 of the first auger 110 has either a right or left hand helix, while the second portion 126 of the first auger 110 has the opposite direction helix so that both the first and second portions 122 and 126 of the pseudo auger 110 urge the developer material 47 toward the plate 100.

To improve the uniformity and increase the volume of developer 47 that passes from the first channel 120 to the second channel 136, preferably, the developer unit 38 includes a second urging member in the form of a second plate 138. The second plate 138 is similar to the first plate 100 and preferably located opposed to the first plate 100 and extends from the shaft 114 in axial alignment with the first port 134. The second plate 138 is preferably connected to either the first portion 122 or the second portion 126 of the pseudo auger 110. As shown in FIG. 1, the second member 100 is connected to the second portion 126 of the pseudo auger 110. It should be appreciated that if the first member 100 is connected to the second portion 126 of the pseudo auger 110, the second member 138 is connected to the first portion 126 of the pseudo auger 110. The second plate 138, as shown in FIG. 1, is connected to the vane 116 of the pseudo auger 110. The second member 138 may alternatively be connected to shaft 114. By placing the first and second plates 100 and 138, respectively, on opposed sides of the shaft 114 and connecting the first and second plates 100 and 138, respectively, to the first portion 120 and second portion 126, respectively of the pseudo auger 110, the torsion rigidity of the auger 110 is optimized. The plates 100 and 138, as shown in FIG. 1, are generally rectangular in shape and extend outwardly beyond the first auger shaft 114 in axial alignment with the first port 134. The shaft 114 and the plates 100 and 138 interconnect the first and second portions 122 and 126, respectively, of the pseudo auger 110.

Figure 2:
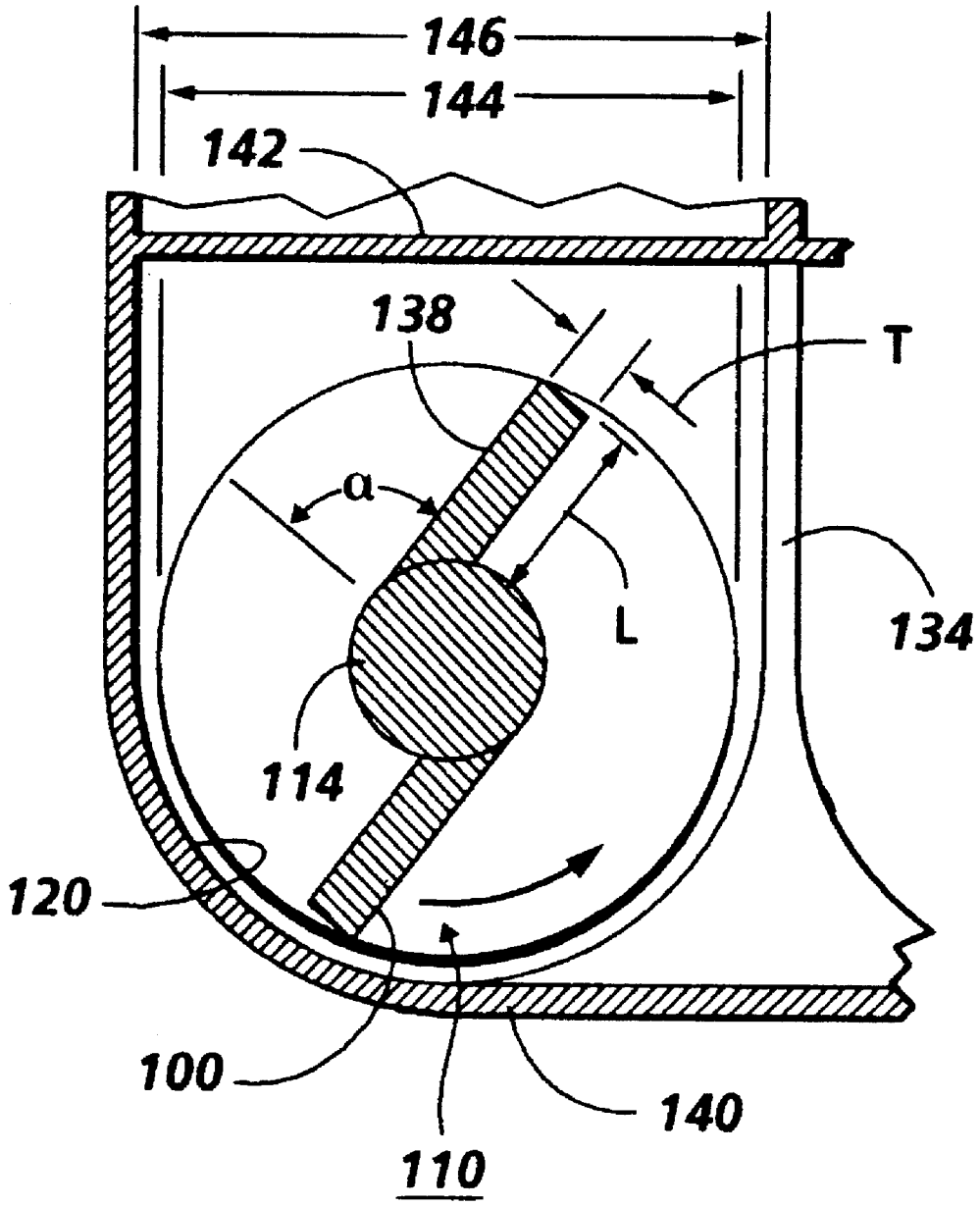
FIG. 2 is a partial cross sectional view in the direction of arrows 2—2 of FIG. 1.

The first plate 100 and the second plate 138 are shown in greater detail in FIG. 2. The auger 110 is confined within the first channel 120 to provide for efficient flow of the developer material 47 along the channel 120, the channel 120 has a close conforming semi-circular bottom 140 and for simplicity may include a flat top 142. The auger 110 has an outer diameter 144 which is slightly smaller than inner diameter 146 of the channel 120.

The plates 100 and 138 extend a length L from shaft 114 and are confined within the auger outer diameter 144. The plates 100 and 138 also have a plate thickness T which for simplicity is uniform. The plate thickness T is chosen to provide the necessary strength depending on the material used for the plate. The plates 100 and 138 also have a plate width W (see FIG. 1). The plate width W and the plate length L (see FIG. 2) are selected to provide the optimum movement of the developer material 47 from the first channel 120 to the second channel 136.

Referring again to FIG. 2, the plates 100 and 138 extend at an angle α relative to the shaft 114. The angle α may be positive, negative, or neutral. The angle α, as shown, is a positive 90 degrees. Or simply stated, the plates 100 and 138 extend tangentially from the shaft 114. The angle α of 90 degrees has been found to optimize the flow of developer material 47.

Referring again to FIG. 1, a second developer transporter 150 is located within the second channel 136. The second transporter 150 is preferably in the form of a spiral auger. The spiral auger 150 includes auger flights 151 having a first spiral auger flight portion 152 for urging the developer material 47 in a first direction 154 away from the second end 130 of the developer housing and a second spiral auger flight portion 156 for transporting the developer material 47 in a second direction 160 away from the first end 105 of the developer housing 44. A third developer urging member 162 is located between the first portion 152 and the second portion 156 of the second auger flights 151. The third member 162 is in the form of a third plate and is similar to the first first and second plates 100 ad 138, respectively. The third developer urging member 162 urges toner outwardly in a radial direction from axis 164 of the second auger 150, through a second port 166, and into the first channel 120.

The third plate 162 is preferably connected to either the first portion 152 or the second portion 156 of the second auger 150. As shown in FIG. 1, the third member 162 is connected to the first portion 152 of the second auger 150. It should be appreciated that the third plate 162 may likewise be connected to the second portion 156 of the second auger 150. The third member 162, as shown in FIG. 1, is connected to the flights 151 of the second auger 150. The third plate 162 may alternatively be connected to a shaft 139 of the second auger 150.

To improve the uniformity and increase the volume of developer 47 that passes from the second channel 136 to the first channel 120, preferably, the developer unit 38 includes a fourth urging member in the form of a fourth plate 163. The fourth plate 163 is similar to the third plate 162 and preferably located opposed to the third plate 162 and extends from the shaft 139 in axial alignment with the second port 166. The fourth plate 163 is preferably connected to either the first portion 152 or the second portion 156 of the second auger 150. As shown in FIG. 1, the fourth plate 163 is connected to the second portion 156 of the second auger 150. It should be appreciated that if the fourth plate 163 is connected to the first portion 152 of the second auger 150, the third plate 162 is connected to the second portion 156 of the pseudo auger 110. The fourth plate 163, as shown in FIG. 1, is connected to the flights 151 of the second auger 150. The fourth plate 163 may alternatively be connected to the shaft 139.

The plates 162 and 163 extend at an angle relative to the shaft 139 similar the angle α of the plates 100 and 138 relative to the shaft 130. The angle may be positive, negative, or neutral.

The pseudo auger 110 and the second auger 150, together with the channels 120 and 136, in which the augers respectively rotate, provide a mixing apparatus 170 within which the developer material 47 is triboelectrically agitated and in which the toner 172 may be added to carrier particles 174 to form the developer material 47.

The developer material 47 located in the sump housing 106 together with the toner 172 enter the first end 105 of the first channel 120 and move along the channel 120 in the first direction 124 toward the plate 100. Developer material 47 near the second end 130 of the first channel 120 moves away from the second end 130 in the second direction 132 toward the plate 100. The developer material 47 and the toner 172 near the plate 100 are urged through the first port 134 as the pseudo auger 110 is rotated in the direction of arrow ! 76 by a first auger motor 180. The motor 180 and the auger 110 may be interconnected by any suitable means such as by gears 182.

The developer material 47 and the toner 172 enter the second channel 136 through the first port 134 and are translated along the second auger 150 as it rotates in the direction of arrow 183. The auger 150 is rotated by a second auger motor 184. The motor 184 and the second auger 150 may be interconnected by any suitable means such as by second auger gears 186. The developer material 47 and the toner 172 are carried along the first portion 152 of the second auger 150 toward the second plate 162 in the direction of arrow 154. Along the way, some developer material 47 is extracted by a transport roll 188 and delivered as a magnetic brush to the development station C (see FIG. 5). Carrier particles 174 from which some of the toner 172 may have been removed in order to develop the latent image upon the photoconductive surface 12 (see FIG. 5) are returned by the transport roll 188 to the second channel 136. Developer material 47, toner 172 and carrier 174, which is located in the second channel 136 near the first end 105 of the developer housing are urged by the second portion 156 of the second auger 150 toward the second plate 162. The second plate 162 urges the developer material 47 through the second port 166 and into the first channel 120. The developer material 47 makes a continuous loop between the first and second channels 120 and 136, respectively. This process thoroughly mixes the toner 172 and the carrier 174 to form the developer material 47 and assists in achieving proper triboelectrical charging.

Figure 3:
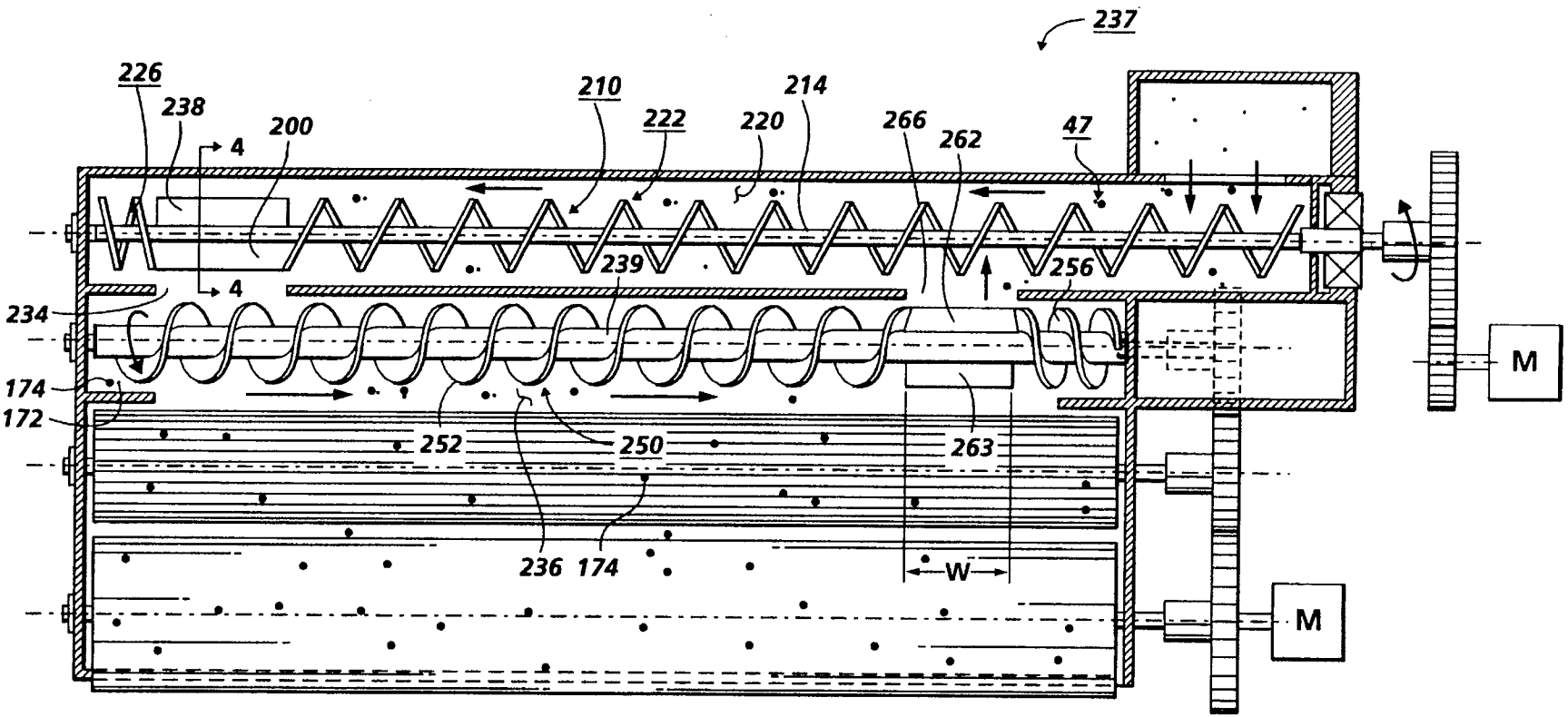
FIG. 3 is a plan view partially in section of an alternate embodiment of the positive push auger of the present invention.
Figure 4:
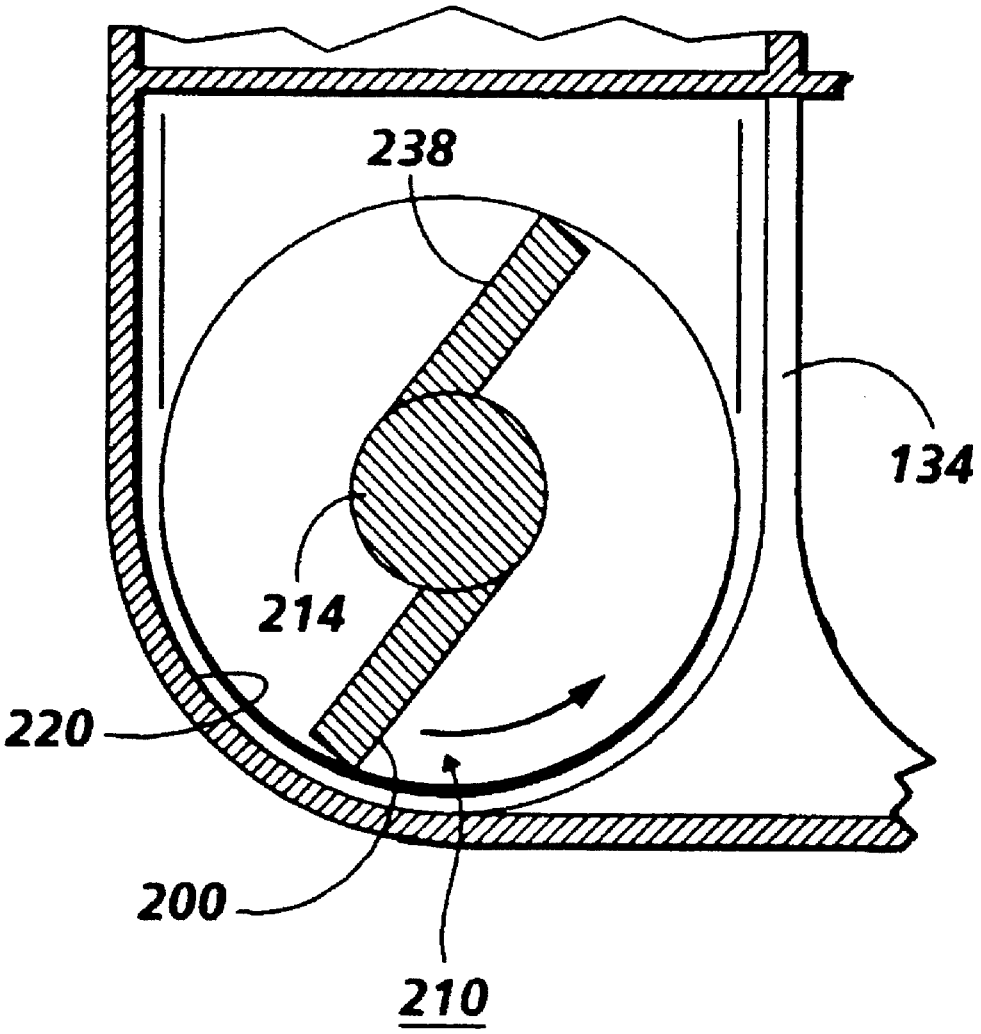
FIG. 4 is a partial cross sectional view in the direction of arrows 4—4 of FIG. 3.

Referring now to FIGS. 3 and 4, an alternative embodiment of the present invention is shown in development system 237. The system 237 is similar to the system 38 of FIGS. 1 and 2 except that the first and second augers 110 and 150 of FIGS. 1 and 2 are replaced by first and second augers 210 and 250, respectively. To urge the developer material 47 from first channel 220 to second channel 236 through first port 234, the first auger 210 includes a first plate 200 which is similar to plate 100 of FIG. 1 and preferably extends tangentially outwardly from the first auger 210. The first plate 200 preferably interconnects first portion 222 and second portion 226 of the first auger 210.

Similarly to the auger 110 of FIG. 1, to improve the uniformity and increase the volume of developer 47 that passes from the first channel 220 to the second channel 236, preferably, the first auger 210 further includes a second plate 238. The second plate 238 is similar to the first plate 200 and preferably is located opposed to the first plate 200. The second plate 238 preferably extends tangentially from and is connected to a first auger shaft 214 and is in axial alignment with the first port 234.

The second auger 250 is located within the second channel 236 and includes a first portion 252 for urging the developer material 47 in a first direction and a second auger portion 256 for transporting the developer material 47 in a second direction. A third plate 262 is located between and interconnects the first portion 252 and the second portion 256 of the second auger 250 and is similar to the first plate 200. The third plate 262 preferably extends tangentially outwardly from the second auger 250. The third plate 262 urges toner outwardly in a radial direction from second auger 250, through a second port 266, and into the first channel 220.

Similarly to the auger 150 of FIG. 1, preferably, the second auger 250 includes a fourth plate 263. The fourth plate 263 is similar to the second plate 238 and preferably is located opposed to the third plate 262. The fourth plate 263 preferably extends tangentially from and is connected to a second auger shaft 239 and is in axial alignment with the first port 234.

The use of the developer urging member between the first and second portions of the auger serve to positively displace the developer material that is located in the first channel through the port into the second channel. The positive displacement of the developer material from the first channel to the second channel of the mixing apparatus minimizes dead zones and the clumping of toner adjacent the ports.

Use of the developer urging member greatly increases the flow of material within the mixing apparatus and improves the uniformity of the developer material level within the housing and assists in triboelectrically charging the developer material.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for recirculating developer material in a developer unit, comprising:

a first auger for transporting the developer material in a first direction;

a second auger, for transporting the developer material in a second direction opposite to the first direction; and a first paddle extending outwardly from said first auger, for moving the developer material in a substantially radial direction from said first auger to said second auger.

2. An apparatus according to claim 1, further comprising a second paddle secured to said second auger for moving the developer material in a substantially radial direction from said second auger to said first auger.

3. An apparatus according to claim 2, wherein said first auger comprises a first vane section and a second vane section of opposite pitch to said first vane section.

4. An apparatus according to claim 3, wherein said second auger comprises a first flight section and a second flight section of opposite pitch to said first flight section.

5. An apparatus according to claim 3, wherein said first paddle comprises a first plate having a substantially planar surface connecting said first vane section with said second vane section of said first auger.

6. An apparatus according to claim 5, wherein said first auger further comprises a shaft centrally located about a longitudinal axis, said first vane section and said second vane section of said first auger extending from said shaft, said first plate extending tangentially from said shaft.

7. An apparatus according to claim 5, further comprising a second plate extending from said first auger and opposed to said first plate.

8. An apparatus according to claim 4, wherein said second paddle comprises a first plate connecting said first flight section of said second auger with said second flight section of said second auger.

9. An apparatus according to claim 3, wherein said first auger comprises a pseudo auger.

10. An apparatus according to claim 4, wherein said second auger comprises a spiral auger.

11. An apparatus according to claim 4, wherein said first paddle comprises a first plate extending from said first vane section of said first auger and extending toward and spaced from said second vane section of said first auger.

12. An apparatus according to claim 11, further comprising a second plate extending from said second vane section of said first auger and extending toward and spaced from said first vane section of said first auger.

13. An apparatus according to claim 4, wherein said second paddle comprises a first plate extending from said first flight section of said second auger and extending toward and spaced from said second flight section of said second auger.

14. An apparatus according to claim 11, wherein said first auger further comprises a shaft centrally located about a longitudinal axis, said first vane section and said second vane section of said first auger extending from said shaft, said first plate extending tangentially from a periphery of said shaft.

15. A particle transport comprising a spiral auger including a first vane section for moving particles in a first direction, a second vane section for moving particles in a second direction opposite to the first direction, and a paddle connected to at least one of said first vane section and said second vane section to move particles substantially transverse to the first direction.

16. A transport according to claim 15, wherein said paddle comprises a plate having a substantially planar surface, said plate connected to at least one of said first vane section and said second vane section.

17. A printing machine of the type having developer material recirculated in a developer unit, wherein the improvement comprises:

a first auger for transporting the developer material in a first direction;

a second auger for transporting the developer material in a second direction opposite to the first direction; and a first paddle extending outwardly from said first auger, for moving the developer material in a substantially radial direction from said first auger to said second auger.

18. A printing machine according to claim 17, further comprising a second paddle secured to said second auger for moving the developer material in a substantially radial direction from said second auger to said first auger.

19. A printing machine according to claim 18, wherein said first auger comprises a first vane section and a second vane section of opposite pitch to said first vane section.

20. A printing machine according to claim 19, wherein said second auger comprises a first flight section and a second flight section of opposite pitch to said first flight section.

21. A printing machine according to claim 19, wherein said first paddle comprises a first plate having a substantially planar surface connecting said first vane section with said second vane section of said first auger.

22. A printing machine according to claim 21, wherein said first auger further comprises a shaft centrally located about a longitudinal axis, said first vane section and said second vane section of said first auger extending from said shaft, said first plate extending tangentially from said shaft.

23. A printing machine according to claim 21, further comprising a second plate extending from said first auger and opposed to said first plate.

24. A printing machine according to claim 20, wherein said second paddle comprises a first plate connecting said first flight section of said second auger with said second flight section of said second auger.

25. A printing machine according to claim 19, wherein said first auger comprises a pseudo auger.

26. A printing machine according to claim 20, wherein said second auger comprises a spiral auger.

27. A printing machine according to claim 20, wherein said first paddle comprises a first plate extending from said first vane section of said first auger and extending toward and spaced from said second vane section of said first auger.

28. An apparatus according to claim 27, further comprising a second plate extending from said second vane section of said first auger and extending toward and spaced from said first vane section of said first auger.

29. An apparatus according to claim 20, wherein said second paddle comprises a first plate extending from said first flight section of said second auger and extending toward and spaced from said second flight section of said second auger.

30. An apparatus according to claim 27, wherein said first auger further comprises a shaft centrally located about a longitudinal axis, said first vane section and said second vane section of said first auger extending from said shaft, said first plate extending tangentially from a periphery of said shaft.

* * * * *